United States Patent [19]

Oldham

[11] 4,272,857

[45] Jun. 16, 1981

[54] LIFEJACKET

[75] Inventor: Walter Oldham, Rochdale, England

[73] Assignee: Beaufort Air-Sea Equipment Ltd., Birkenhead, England

[21] Appl. No.: 920,968

[22] Filed: Jun. 30, 1978

[30] Foreign Application Priority Data

Sep. 1, 1977 [GB] United Kingdom ..... 36454/77

[51] Int. Cl.[3] ..... B63C 9/08

[52] U.S. Cl. ..... 9/345; 9/316; 9/342

[58] Field of Search ..... 9/311, 314–327, 9/329, 333, 340, 341, 342, 345

[56] References Cited

U.S. PATENT DOCUMENTS

| | | | |
|---|---|---|---|
| 2,742,654 | 4/1956 | Hurt | 9/345 |
| 2,782,429 | 2/1957 | Hennebutte | 9/345 |
| 3,248,746 | 5/1966 | Bernhardt | 9/345 |
| 3,321,785 | 5/1967 | Soubiran | 9/316 |
| 3,354,480 | 11/1967 | Harding | 9/316 |
| 3,447,175 | 6/1969 | Sullivan | 9/316 |

*Primary Examiner*—Trygve M. Blix
*Assistant Examiner*—D. W. Keen
*Attorney, Agent, or Firm*—Oblon, Fisher, Spivak, McClelland & Maier

[57] ABSTRACT

A lifejacket has an inflatable body defining a head receiving opening having a closed periphery. The opening is elongated to reduce the stress tending to open the seam at the periphery of the body when inflated. Restraints join the periphery of the opening on the side remote from the head end of the body to the head end of the body on opposite faces respectively of the body. These restraints are so dimensioned that, when the body is deflated, they lie loosely across the opening and do not impede insertion of the wearer's head therethrough and when the body is inflated, they are stretched taut across the opening and inhibit the wearer's head slipping back through the opening.

11 Claims, 2 Drawing Figures

LIFEJACKET

Figure 1:
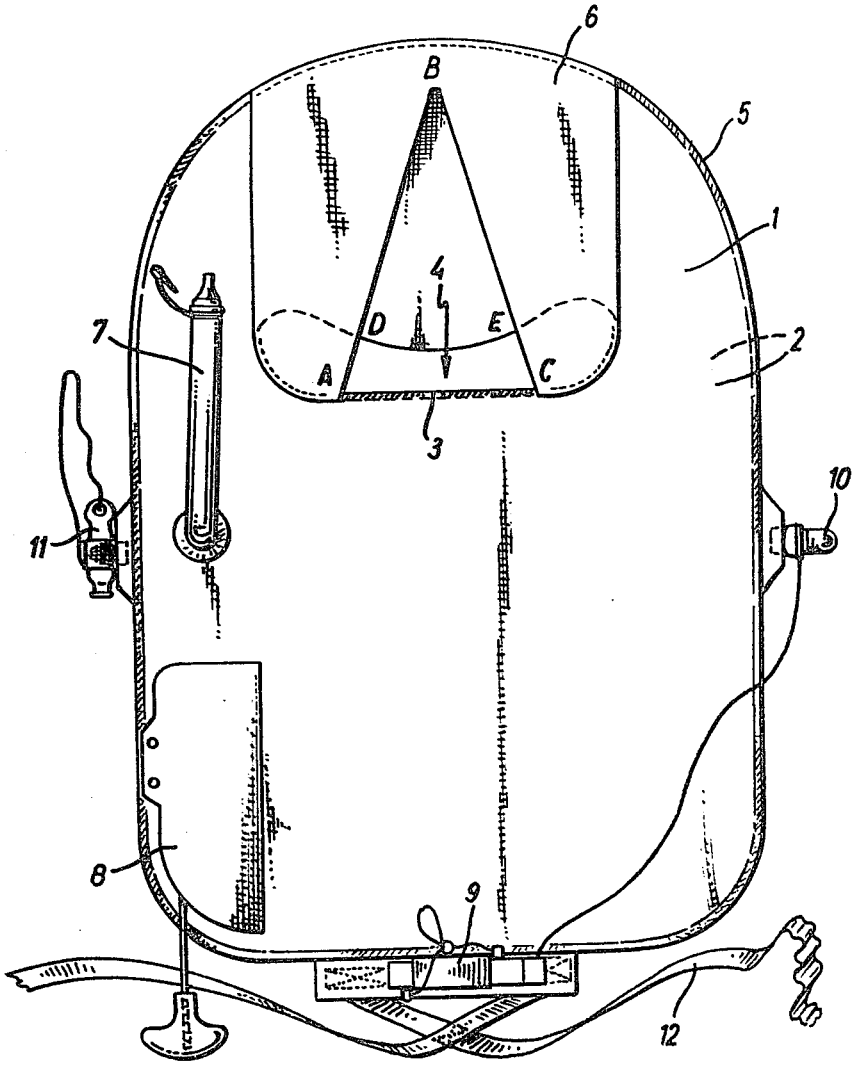

The present invention relates to an inflatable jacket.

The body of well known conventional lifejackets is made by superposing two similarly shaped pieces of gasproof or gasproofed material and adhering them together along their peripheries to produce a gasproof seam. In emergency use, when the body of the lifejacket is inflated, this gastight seam is subjected to a considerable tensile force. To counteract this force, it is usual to construct the peripheral seam in the form of a hinge with a folded piece of material being placed between the two superposed pieces of material forming the body of the lifejacket and with another folded piece of material placed over the two superposed pieces of material at the seam. This method produces a satisfactory seam which will resist the internal pressure of the inflated lifejacket, but the seam is difficult, time consuming and therefore expensive to produce.

The inflation chamber of the conventional lifejacket adopts, when inflated, a substantially circular cross-section. The tension in the material defining the cross-section is equal to the product of the internal pressure and the radius of the cross-section. That part of the seam of the conventional lifejacket most likely to give first, therefore, is the curved section at the base of the head receiving aperture. At this section, a relatively short length of seam is subjected to a relatively high tension due to the large radius of the inflated base portion of the lifejacket. The problem can be mitigated by lengthening the portion of the seam subjected to this pressure, but this produces an elongate aperture which is distorted on inflation and which, therefore, may allow the wearer's head to slip out in use.

According to the present invention, there is provided an inflatable lifejacket comprising a body defining an aperture adapted to receive the wearer's head, means for inflating the lifejacket and restraint means connected to the body of the lifejacket in relation to the aperture such that, in the deflated condition of the lifejacket, the wearer may don the lifejacket, and in the inflated condition of the lifejacket the restraint means are tensioned to inhibit the wearer's head slipping back through the aperture.

A preferred embodiment of the invention may comprise any one or more of the following advantageous features:

(a) The aperture is elongate with the longitudinal axis of the aperture transverse to the line joining the head and tail of the lifejacket.

(b) The restraint means comprise a piece or pieces of material fastened so as to lay across the aperture.

(c) The piece of material of (b) is 'U'-shaped with the base of the 'U' fastened to the head end of the lifejacket and the free ends of the arms of the 'U' fastened on the chest side of the aperture.

(d) The restraint means comprises an apertured piece or pieces of material fastened so as to lay across the aperture on both faces of the lifejacket.

(e) The restraint means are dimensioned so that, with the lifejacket lying flat in a deflated condition, its length is equal to or shorter than the distance between the points at which it is fastened to the lifejacket.

(f) The lifejacket comprises oral inflation means.

(g) The lifejacket comprises $CO_2$ inflation means.

(h) The lifejacket is made of thermoplastic polyurethane coated fabric.

Figure 2:
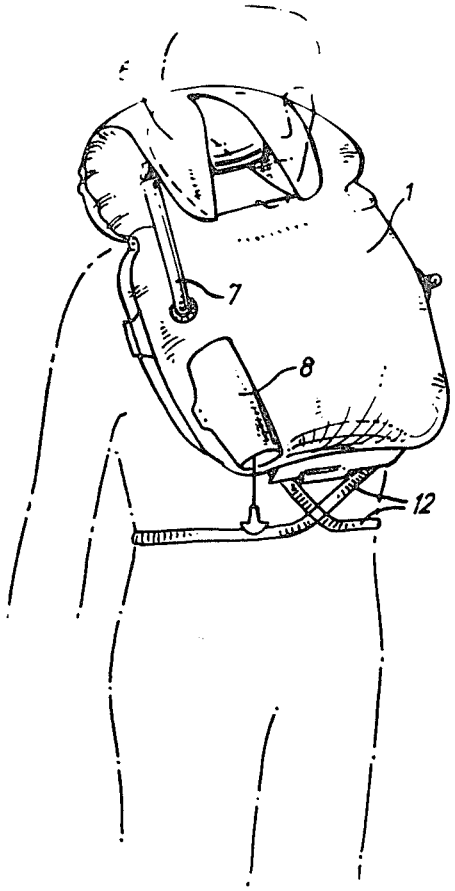

In order that the invention may be more clearly understood, one embodiment thereof will now be described by way of example with reference to the accompanying drawing in which:

FIG. 1 shows a plan view of a lifejacket according to the invention in a deflated condition, and, FIG. 2 shows the lifejacket of FIG. 1 inflated and in use.

Referring to the drawing, the lifejacket comprises a main body 1 composed of two superposed pieces of thermoplastic polyurethane coated nylon fabric 2. These pieces of coated fabric 2 are welded around their internal and external peripheries to produce an internal seam 3 defining an aperture 4 and an external seam 5. Restraint means in the form of two substantially U-shaped pieces of material 6 are connected across the aperture 4 on opposite faces respectively of the main body 1 of the lifejacket. Each piece 6 is connected to the main body 1 of the lifejacket by rows of stitching or welding at the base of the U and at the ends of the free arms of the U. Other forms of connection may of course be employed.

The lifejacket comprises oral inflation means 7, $CO_2$ inflation means ($CO_2$ cylinder not shown) 8, a water activateable battery 9 connected to supply current to a lamp 10, a whistle 11 and a harness 12. The harness is worn as shown in FIG. 2 with the wearer's head extending through the aperture 4 between the arms of the U of each piece of material 6. Each piece of material 6 is so dimensioned that with the lifejacket lying flat in a deflated condition, the distance between the points on the main body 1 of the lifejacket at which the piece of material is fastened is equal to or longer than the length of the piece of material 6 itself, the distance being considered in the head to tail direction of the lifejacket. When the lifejacket is inflated, there would be a tendency without the restraint means, for the aperture 4 to assume a more circular shape. Not only is this tendency counteracted by the pieces of material 6, but the pieces of material are themselves tensioned as they now follow the curved path of the inflated lifejacket and they therefore inhibit any tendency of the wearer's head to slip back through the aperture 4. In the deflated condition of the lifejacket, the pieces of material 6 are relatively slack and may be pushed apart to allow easy access of the wearer's head through the aperture 4.

The periphery of the aperture bounded by the sum of the inner sides of the U shaped aperture (AB and BC) and the distance between the inner points of attachment of the legs of the U shaped piece (AC) shall be sufficient to allow the wearer's head to pass through. On inflation the effective aperture is reduced to the periphery bounded by points ADEC.

It will be appreciated that the invention has been described by way of example only and that many variations are possible without departing from the scope of the invention. In particular, the restraint means may take many different forms other than that described.

What is claimed is:

1. An inflatable lifejacket comprising a body defining an aperture adapted to receive the wearer's head and defining an upper head portion positioned behind a users head and a chest portion positioned immediately below said aperture, means for inflating the lifejacket and restraint means in the form of sheet material connected to the body of the lifejacket and extending over a portion of the aperture between said head portion and at least one side of said chest portion wherein said restraint means are dimensioned such that, in the deflated condition of the lifejacket, the restraint means are loose and the wearer may don the lifejacket, and in the inflated condition of the lifejacket the sheet material is tensioned to be stretched over the aperture to inhibit the wearer's head slipping back through the aperture.

2. An inflatable lifejacket as claimed in claim 1, in which the aperture is elongate with the longitudinal axis of the aperture transverse to the line joining the head and tail of the lifejacket.

3. An inflatable lifejacket as claimed in claim 1, in which the restraint means comprise at least one piece of material.

4. An inflatable lifejacket as claimed in claim 3, in which the piece of material is U-shaped with the base of the U fastened to the head end of the lifejacket and the free ends of the arms of the U fastened on the chest side of the aperture.

5. An inflatable lifejacket as claimed in claim 1, in which the restraint means comprises at least one apertured piece of material.

6. An inflatable lifejacket as claimed in claim 1, in which the restraint means are dimensioned so that, with the lifejacket lying flat in a deflated condition, its length is not greater than the distance between the points at which it is fastened to the lifejacket.

7. An inflatable lifejacket as claimed in claim 1 or 2 or 3 or 4 or 5 or 6, in which oral inflation means are provided.

8. An inflatable lifejacket as claimed in claim 1, in which $CO_2$ inflation means are provided.

9. An inflatable lifejacket as claimed in claim 1, made of thermoplastics polyurethane coated fabric.

10. An inflatable lifejacket as claimed in claim 1, in which the restraint means are connected to the body by stitching.

11. An inflatable lifejacket as claimed in claim 1, in which the restraint means are connected to the body by welding.

* * * * *